US010638823B2

(12) United States Patent
Nakasone et al.

(10) Patent No.: US 10,638,823 B2
(45) Date of Patent: May 5, 2020

(54) HAIR IRON

(71) Applicant: Panasonic Intellectual Property Management Co., Ltd., Osaka (JP)

(72) Inventors: Hidetoshi Nakasone, Shiga (JP); Soshi Takano, Shiga (JP); Tsuyoshi Saito, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 329 days.

(21) Appl. No.: 15/850,859

(22) Filed: Dec. 21, 2017

(65) Prior Publication Data

US 2018/0177272 A1 Jun. 28, 2018

(30) Foreign Application Priority Data

Dec. 26, 2016 (JP) ..... 2016-251285

(51) Int. Cl.

| | |
|---|---|
| ***A45D 20/08*** | (2006.01) |
| ***A45D 1/06*** | (2006.01) |
| ***A45D 1/04*** | (2006.01) |
| ***A45D 2/00*** | (2006.01) |
| *A45D 1/00* | (2006.01) |

(52) U.S. Cl.

CPC ..... *A45D 1/06* (2013.01); *A45D 1/04* (2013.01); *A45D 2/001* (2013.01); *A45D 2001/002* (2013.01); *A45D 2200/202* (2013.01)

(58) Field of Classification Search

CPC ... A45D 1/06; A45D 1/08; A45D 1/00; A45D 1/04; A45D 2/001; A45D 2/002; A45D 2002/003; A45D 2001/002; A45D 2200/202

See application file for complete search history.

(56) References Cited

U.S. PATENT DOCUMENTS

| | | | | |
|---|---|---|---|---|
| 4,242,567 | A * | 12/1980 | Carter | A45D 2/001 132/224 |
| 2005/0172979 | A1* | 8/2005 | Saida | A45D 1/04 132/228 |
| 2012/0126041 | A1 | 5/2012 | Nunomura et al. | |
| 2012/0291797 | A1* | 11/2012 | deGrood | A45D 1/28 132/211 |

FOREIGN PATENT DOCUMENTS

| | | | |
|---|---|---|---|
| JP | 2009-268502 | A | 11/2009 |
| JP | 2011-067738 | A | 4/2011 |
| JP | 2015-104448 | A | 6/2015 |
| WO | 2011/024766 | A1 | 3/2011 |

* cited by examiner

*Primary Examiner* — Rachel R Steitz

(74) *Attorney, Agent, or Firm* — McDermott Will & Emery LLP

(57) ABSTRACT

A hair iron according to the present disclosure is configured to hold hair in a state in which a first hair holding surface and a second hair holding surface face each other. A first hair holder includes ion outlets configured to release ions generated by a discharge device. The discharge device includes a first electrode having a plurality of discharge electrodes. The first electrode includes an electrode body having a plate shape. The discharge electrodes are disposed on a side portion e end of the electrode body as the electrode body is viewed in a thickness direction thereof. The discharge electrodes include two types of discharge electrodes of which shapes are different from each other.

11 Claims, 11 Drawing Sheets

HAIR IRON

RELATED APPLICATIONS

This application claims the benefit of priority to Japanese Application No. 2016-251285, filed on Dec. 26, 2016, the disclosure of which is incorporated by reference herein in its entirety.

BACKGROUND

1. Technical Field

The present disclosure relates to a hair iron.

2. Description of the Related Art

Unexamined Japanese Patent Publication No. 2009-268502 discloses a hair care apparatus incorporating a discharge device, which enhances hair care effects by applying ions that are generated by the discharge device to hair.

Unexamined Japanese Patent Publication No. 2009-268502 cites a hair drier, a hair iron, and a hairbrush as examples of the hair care apparatus.

SUMMARY

Demand for sleek designs (narrow shapes) has been growing for recent hair irons.

However, the hair iron disclosed in Unexamined Japanese Patent Publication No. 2009-268502 includes a discharge device of substantially the same shape as a discharge device mounted on a hair drier. In other words, Unexamined Japanese Patent Publication No. 2009-268502 discloses simply applying a configuration of the discharge device mounted on a hair drier to a hair iron.

Such a configuration requires an increase in the width and the thickness of a hair iron to secure an installation space of the discharge device, which results in upsizing of a hair iron.

As described above, slimming down of hair irons while enhancing hair care effects has been difficult according to the above conventional technique.

To solve the above conventional problem, an object of the present disclosure is to provide a hair iron capable of attaining a slimmed body while enhancing hair care effects.

To solve the above conventional problem, a hair iron according to the present disclosure includes: a first hair holder with a first hair holding surface; and a second hair holder with a second hair holding surface configured to face the first hair holding surface. The hair iron is configured to hold hair in a state in which the first hair holding surface and the second hair holding surface face each other.

The first hair holder includes a discharge device configured to generate ions, and the first hair holder also includes ion outlets configured to release ions generated by the discharge device.

The discharge device includes a first electrode having a plurality of discharge electrodes, and the first electrode includes an electrode body having a plate shape. Here, the plate shape includes a "substantially plate shape".

The discharge electrodes are disposed on a side portion on one end of the electrode body as the electrode body is viewed in a thickness direction of the electrode body, and the discharge electrodes include two types of discharge electrodes of which shapes are different from each other.

Since the discharge electrodes are disposed on the side portion on one end of the electrode body as described above, an installation space of the discharge device can be minimized in the first hair holder, thereby attaining a slimmed body of the hair iron. In addition, since the discharge electrodes include two types of discharge electrodes of which shapes are different from each other, the two types of discharge electrodes can have different primary functions, thereby enhancing hair care effects.

In this manner, the above hair iron can attain a slimmed body while enhancing hair care effects.

To solve the above conventional problem, a hair iron according to the present disclosure includes: a first hair holder with a first hair holding surface; and a second hair holder with a second hair holding surface configured to face the first hair holding surface. The hair iron is also configured to hold hair in a state in which the first hair holding surface and the second hair holding surface face each other.

The first hair holder includes a discharge device configured to generate ions, and the first hair holder also includes ion outlets configured to release ions generated by the discharge device.

The discharge device includes a first electrode having a discharge electrode, and a second electrode having a counter electrode that is separated from the discharge electrode to generate an electrical discharge between the counter electrode and the discharge electrode, and the first electrode includes an electrode body having a plate shape. Here, the plate shape includes a "substantially plate shape".

The discharge electrode is disposed on a side portion on one end of the electrode body as the electrode body is viewed in a thickness direction of the electrode body, and the counter electrode is disposed to surround at least two sides of the side portion as the side portion is viewed from the one end of the electrode body.

Since the discharge electrode is disposed on the side portion on one end of the electrode body and the counter electrode configured to generate an electrical discharge between the counter electrode and the discharge electrode is disposed to surround at least two sides of the side portion, electric field concentration at the counter electrode can be reduced. As a result, occurrence of arcing is suppressed between the discharge electrode and the counter electrode, so that the counter electrode can be disposed closer to the discharge electrode, thereby minimizing an installation space of the discharge device in the first hair holder.

As described above, a hair iron capable of attaining a slimmed body while enhancing hair care effects can be obtained by minimizing an installation space of the discharge device for enhancing hair care effects.

According to the present disclosure, a hair iron capable of attaining a slimmed body while enhancing hair care effects can be obtained.

DETAILED DESCRIPTION

Figure 1:
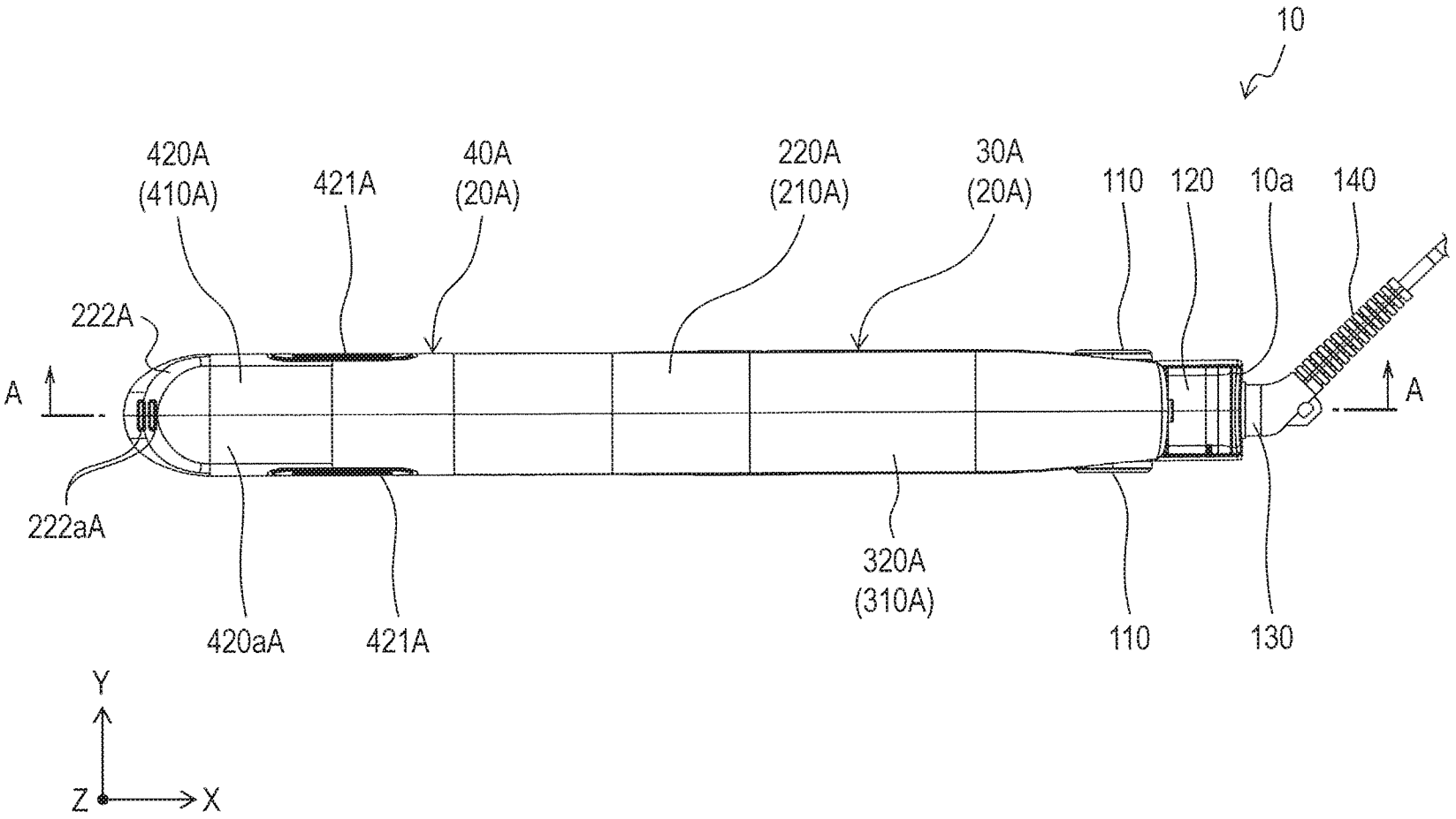
FIG. 1 is a plan view of a hair iron according to a first exemplary embodiment of the present disclosure.

A hair iron according to the present disclosure includes: a first hair holder with a first hair holding surface; and a second hair holder with a second hair holding surface configured to face the first hair holding surface. The hair iron is configured to hold hair in a state in which the first hair holding surface and the second hair holding surface face each other.

The first hair holder includes a discharge device configured to generate ions, and the first hair holder also includes ion outlets configured to release ions generated by the discharge device.

The discharge device includes a first electrode having a plurality of discharge electrodes, and the first electrode includes an electrode body having a plate shape. Here, the plate shape includes a "substantially plate shape".

The discharge electrodes are disposed on a side portion on one end of the electrode body as the electrode body is viewed in a thickness direction of the electrode body, and the discharge electrodes include two types of discharge electrodes of which shapes are different from each other.

Since the discharge electrodes are disposed on the side portion on one end of the electrode body as described above, an installation space of the discharge device can be minimized in the first hair holder, thereby attaining a slimmed body of the hair iron. In addition, since the discharge electrodes include two types of discharge electrodes of which shapes are different from each other, the two types of discharge electrodes can have different primary functions, thereby enhancing hair care effects.

In this manner, the above hair iron can attain a slimmed body while enhancing hair care effects.

The discharge device may include a second electrode having a counter electrode that is separated from the discharge electrodes to generate an electrical discharge between the counter electrode and each of the discharge electrodes.

The counter electrode may be disposed to surround at least two sides of the side portion as the side portion is viewed from the one end of the electrode body.

Since the discharge electrodes are disposed on the side portion on one end of the electrode body and the counter electrode configured to generate an electrical discharge between each of the discharge electrodes and the counter electrode is disposed to surround at least two sides of the side portion, electric field concentration at the counter electrode can be reduced. As a result, occurrence of arcing is suppressed between the discharge electrodes and the counter electrode, so that the counter electrode can be disposed closer to the discharge electrodes, thereby minimizing an installation space of the discharge device in the first hair holder.

A hair iron according to the present disclosure includes: a first hair holder with a first hair holding surface; and a second hair holder with a second hair holding surface configured to face the first hair holding surface. The hair iron is also configured to hold hair in a state in which the first hair holding surface and the second hair holding surface face each other.

The first hair holder includes a discharge device configured to generate ions, and the first hair holder also includes ion outlets configured to release ions generated by the discharge device.

The discharge device includes a first electrode having a discharge electrode, and a second electrode having a counter electrode that is separated from the discharge electrode to generate an electrical discharge between the counter electrode and the discharge electrode, and the first electrode includes an electrode body having a plate shape. Here, the plate shape includes a "substantially plate shape".

In the hair iron, the discharge electrode may be disposed on a side portion on one end of the electrode body as the electrode body is viewed in a thickness direction of the electrode body, and the counter electrode may be disposed to surround at least two sides of the side portion as the side portion is viewed from the one end of the electrode body.

Since the discharge electrode is disposed on the side portion on one end of the electrode body and the counter electrode configured to generate an electrical discharge between the discharge electrode and the counter electrode is disposed to surround at least two sides of the side portion, electric field concentration at the counter electrode can be reduced. As a result, occurrence of arcing is suppressed between the discharge electrodes and the counter electrode, so that the counter electrode can be disposed closer to the discharge electrodes, thereby minimizing an installation space of the discharge device in the first hair holder.

As described above, a hair iron capable of attaining a slimmed body while enhancing hair care effects can be obtained by minimizing an installation space of the discharge device for enhancing hair care effects.

The counter electrode may have a frame shape and may be disposed to surround four sides of the side portion as the side portion is viewed from the one end of the electrode body.

With this configuration, since electric field concentration at the counter electrode can be further reduced, the counter electrode can be disposed closer to the discharge electrode. This results in a further reduction of an installation space of the discharge device in the first hair holder. The first hair holder may include a liquid passage having a liquid inlet and configured to supply liquid to the discharge electrode.

With this configuration, liquid can be changed into charged fine particles in the discharge device without providing a liquid supply mechanism in the discharge device.

An electrode holder holding the electrode body may be provided in the first hair holder, and a through hole that forms a part of the liquid passage may be provided in the electrode holder near the discharge electrode.

With this configuration, space for the liquid passage can be saved, and in addition, liquid introduced from the liquid inlet can be efficiently supplied to the discharge electrode.

The liquid inlet may be disposed on the first hair holding surface.

Disposing the liquid inlet on the first hair holding surface eliminates the need of securing a place for the liquid inlet on the outside of the first hair holding surface, thereby enabling a hair iron to have a further slimmed body.

In addition, the liquid inlet may be disposed on an end of the first hair holding surface.

This configuration can suppress a situation where a hair holding part in the first hair holding surface is divided by the liquid inlet. As a result, a hair iron can attain a further slimmed body while suppressing impairment of a treatment effect.

Exemplary embodiments of the present disclosure are described in detail below with reference to the drawings. Note that the exemplary embodiments should not be construed as limiting the present disclosure.

In the following description, a vertical direction is defined with reference to a hair iron in a state in which the first hair holding surface and the second hair holding surface are closed to each other (the first hair holder and the second hair holder are folded) with the first hair holding surface facing upward. The side of the hair iron where the hair holders are provided is regarded as front, and the side of the hair iron where the griping units are provided is regarded as rear.

In addition, a front-rear direction according to the above definition (a longitudinal direction of the first hair holding surface and the second hair holding surface) is referred to as X-direction, a width direction (a lateral direction of the first hair holding surface and the second hair holding surface) is referred to as Y-direction, and a vertical direction (a thickness direction of the first hair holder and the second hair holder according to the above definition) is referred to as Z-direction.

First Exemplary Embodiment

Figure 2:
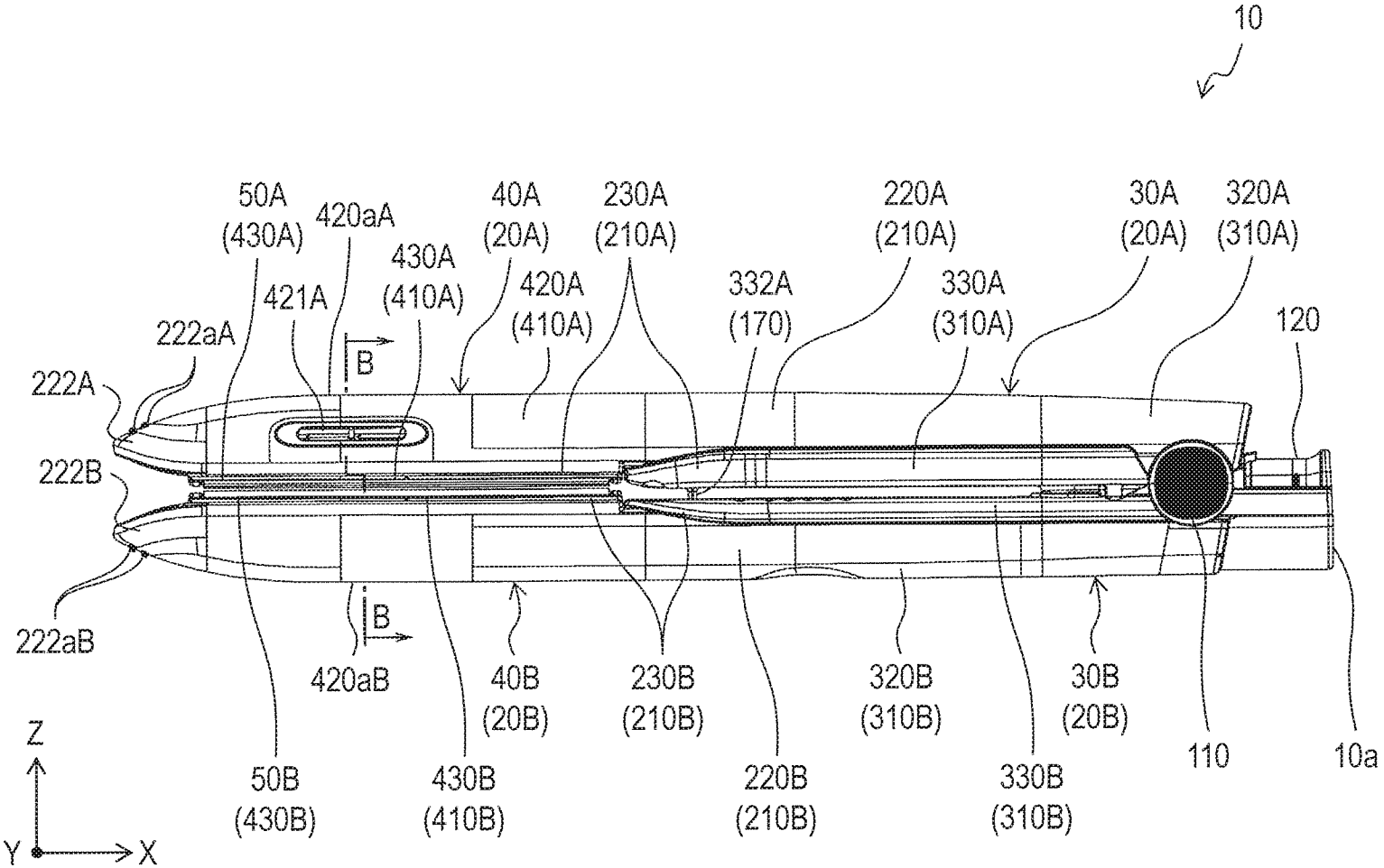
FIG. 2 is a side view of the hair iron according to the first exemplary embodiment of the present disclosure in a state in which a first hair holding surface faces a second hair holding surface.
Figure 3:
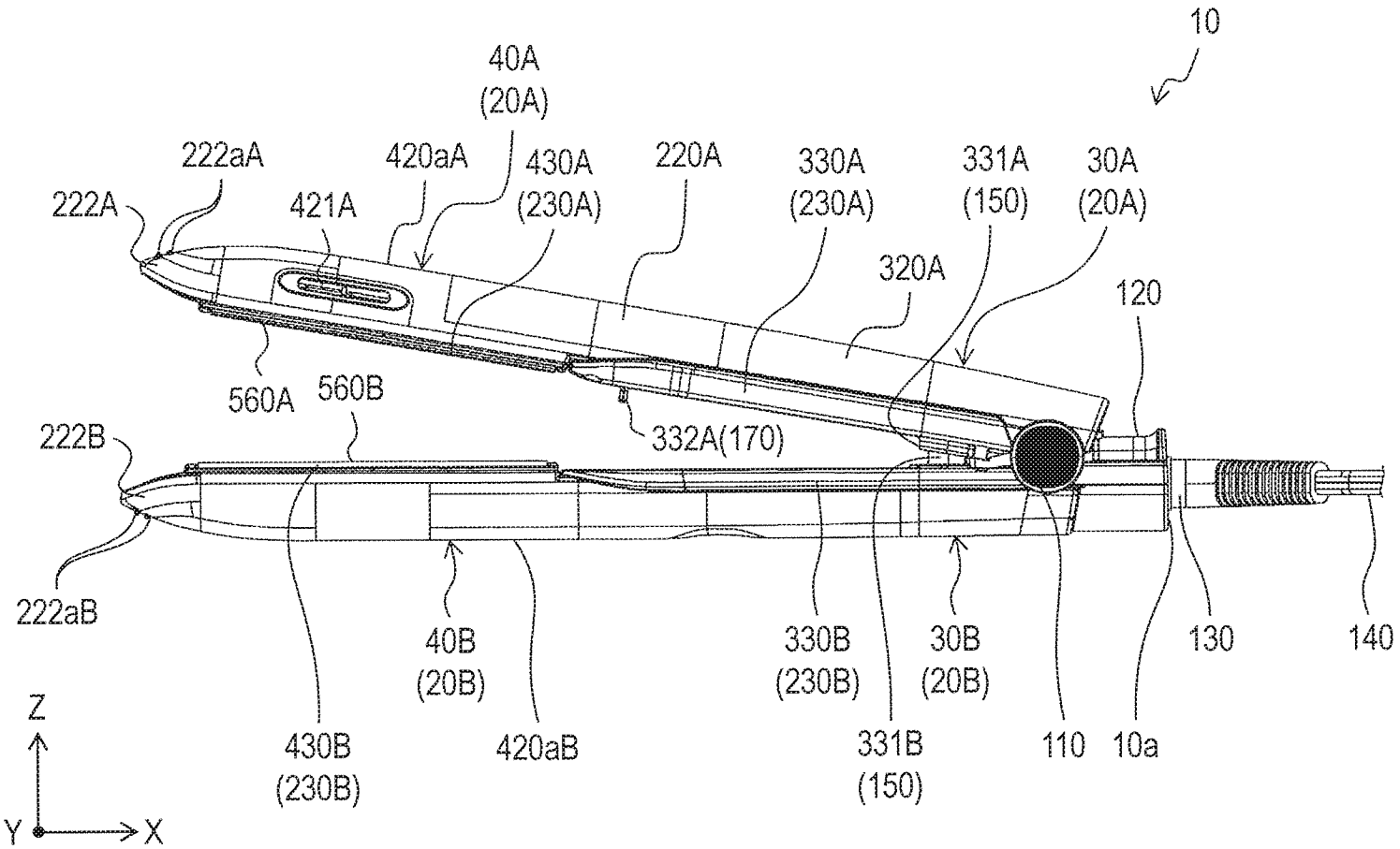
FIG. 3 is a side view of the hair iron according to the first exemplary embodiment of the present disclosure in a state in which a first hair holder and a second hair holder are separated from each other.

As shown in FIGS. 1 to 3, hair iron 10 according to a first exemplary embodiment includes first arm unit (upper arm unit) 20A and second arm unit (lower arm unit) 20B connected with each other through pivotal connector 110 in an expandable manner in a substantially V-shape. First arm unit 20A and second arm unit 20B are relatively rotated through pivotal connector 110 so that an end of first arm unit 20A and an end of second arm unit 20B can come in contact with and be separated from each other.

In other words, according to the first exemplary embodiment, a relative rotation of first arm unit 20A and second arm unit 20B allows first hair holding surface 560A and second hair holding surface 560B described below to come close to and separate from each other.

Figure 4:
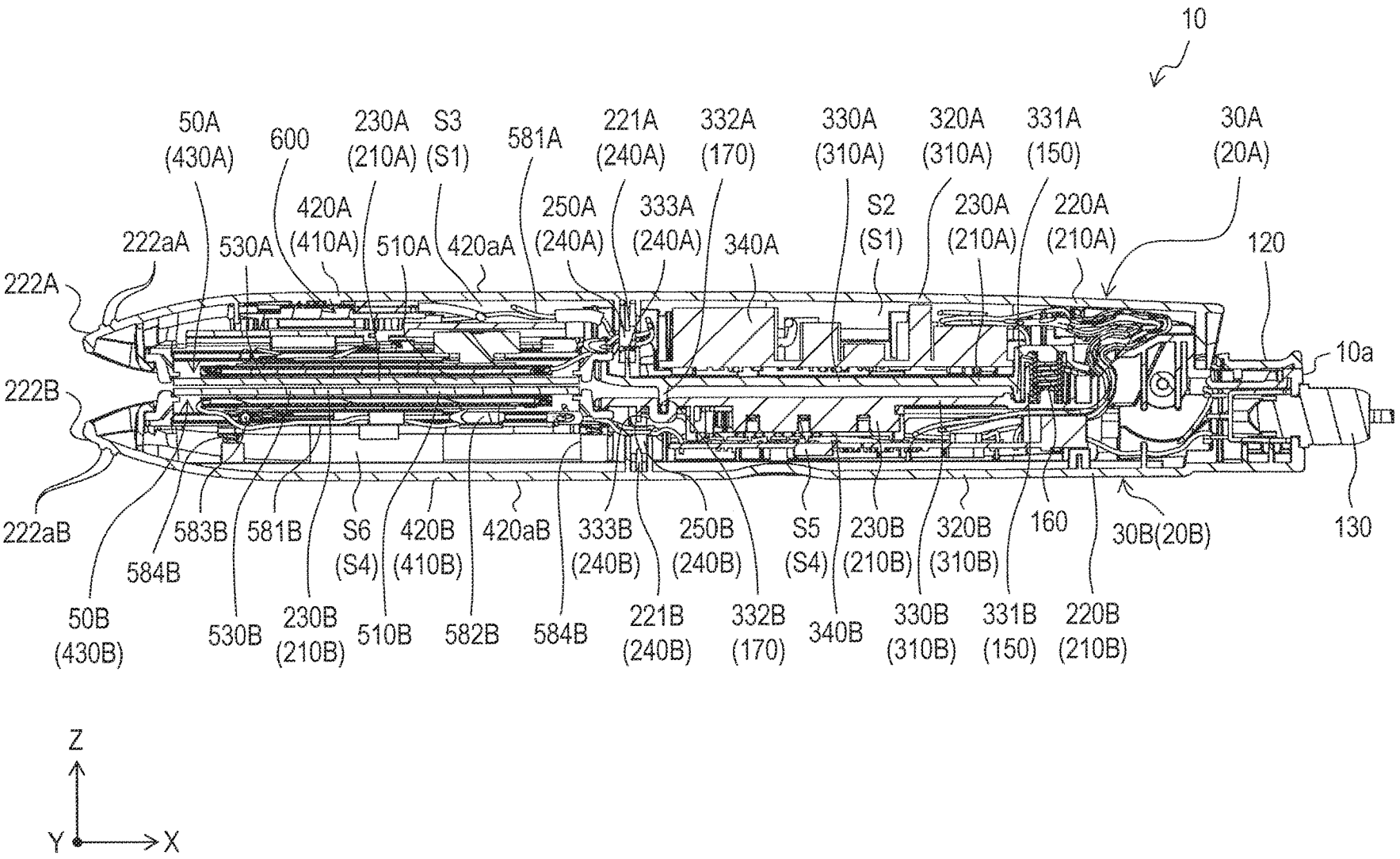
FIG. 4 is a sectional view taken along line A-A in FIG. 1.

According to the first exemplary embodiment, hair iron 10 includes misalignment suppressing unit 150 that suppresses a misalignment between first arm unit 20A and second arm unit 20B in Y-direction (width direction) when opening and closing hair iron 10 (see FIGS. 3 and 4). Specifically, cylindrical unit 331A opening downwardly is provided on first arm unit 20A near pivotal connector 110, and cylindrical unit 331B opening upwardly and configured to be inserted in cylindrical unit 331A is provided on second arm unit 20B near pivotal connector 110.

Hair iron 10 is configured to open or close in a state in which cylindrical unit 331B is inserted in cylindrical unit 331A. In this manner, according to the first exemplary embodiment, cylindrical unit 331A and cylindrical unit 331B form misalignment suppressing unit 150.

According to the first exemplary embodiment, coil spring 160 is provided in a space formed by cylindrical unit 331A and cylindrical unit 331B (see FIG. 4), and coil spring 160 urges first arm unit 20A and second arm unit 20B to spread apart from each other. In the first exemplary embodiment, rotational movements of first arm unit 20A and second arm unit 20B in the spreading apart direction are limited by a stopper (not shown).

Hair iron 10 includes lock button 120 at rear end 10*a* so that first arm unit 20A and second arm unit 20B can be kept in a closed state by operating (pressing) lock button 120.

In other words, hair iron 10 is configured to prevent an urging force of coil spring 160 from spreading apart first arm unit 20A and second arm unit 20B by an operation of lock button 120.

First arm unit 20A and second arm unit 20B respectively include first gripping unit (upper gripping unit) 30A and second gripping unit (lower gripping unit) 30B adjacent to pivotal connector 110 (a rear side in the X-direction of hair iron 10). First arm unit 20A and second arm unit 20B respectively include on tip ends thereof (a front side in the X-direction of hair iron 10) first hair holder (upper hair holder) 40A and second hair holder (lower hair holder) 40B.

First hair holder 40A and second hair holder 40B respectively include first hair holding surface (upper hair holding surface) 560A and second hair holding surface (lower hair holding surface) 560B that are configured to come close to or separate from each other (configured to face each other) when first arm unit 20A and second arm unit 20B are rotated relative to each other.

Figure 5:
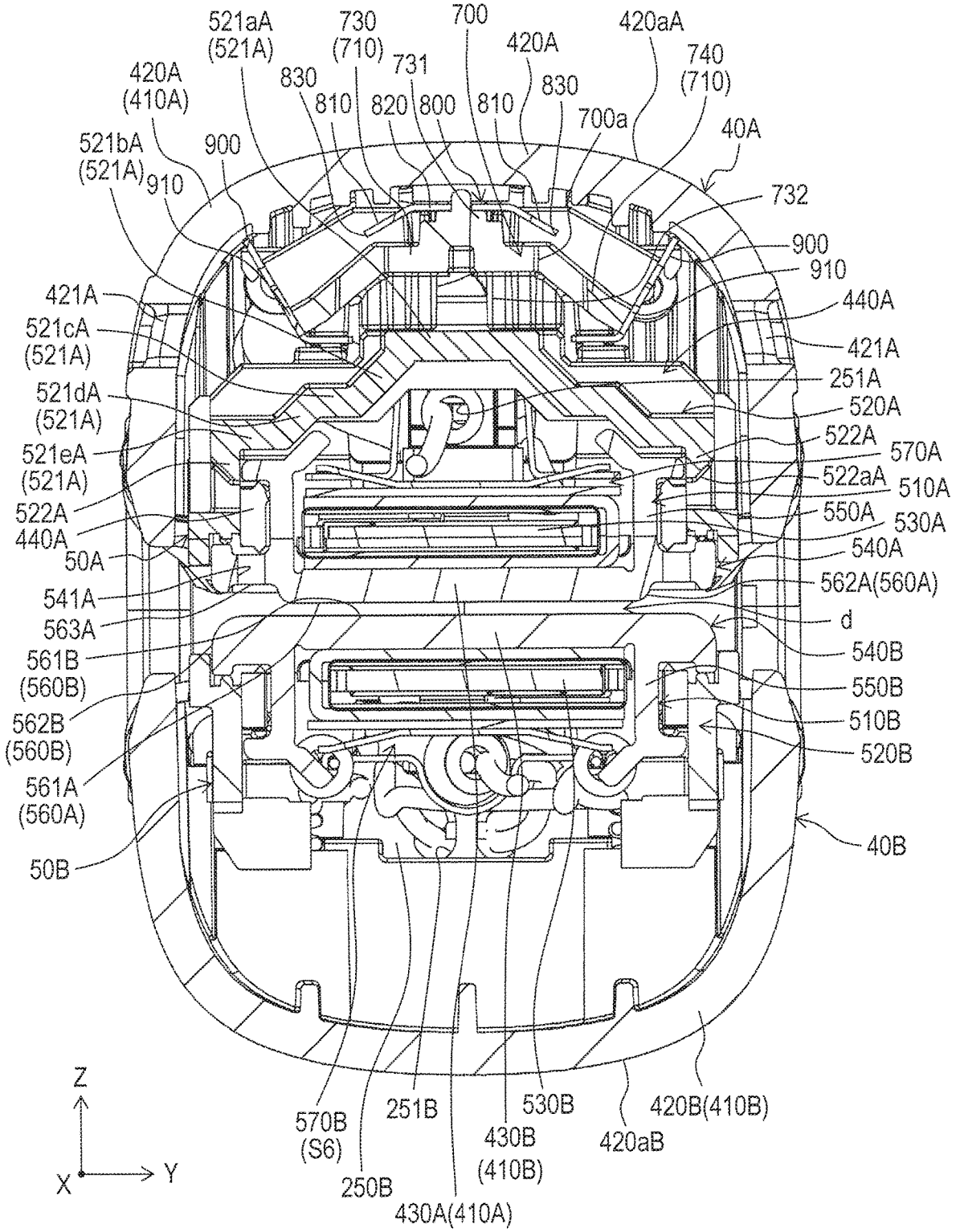
FIG. 5 is a sectional view taken along line B-B in FIG. 2.

According to the first exemplary embodiment, hair holders 40A, 40B respectively include exterior surfaces 420*a*A, 420*a*B each having a curved shape as shown in FIG. 5 so that hair can be curled by winding the hair around the exterior surfaces (exterior surface 420*a*A and/or exterior surface 420*a*B).

In the first exemplary embodiment, the exterior surface of first hair holder 40A refers to a surface on a back side of first hair holding surface 560A among outer peripheral surfaces of first hair holder 40A. The exterior surface of second hair holder 40B refers to a surface on a hack side of second hair holding surface 560B among outer peripheral surfaces of second hair holder 40B.

In other words, referring to FIG. 5, a surface among the outer peripheral surfaces of first hair holder 40A except the lower surface thereof and a surface among the outer peripheral surfaces of second hair holder 40B except the upper surface thereof correspond to the exterior surface of first hair holder 40A and the exterior surface of second hair holder 40B, respectively.

According to the first exemplary embodiment, first hair holder 40A and second hair holder 40B further include heater 530A and heater 530B serving as heating members, respectively (see FIG. 5).

Power cord 140 is attached to rear end 10*a* of hair iron 10 through rotational connector 130, and power cord 140 is electrically connected to control device (electrical component) 340B, which is configured to control the heaters (heater 530A and heater 530B), through lead line 581B.

Hair iron 10 further includes an operation switch (not shown) so that energization of the heaters (heater 530A and heater 530B) can be turned on or off by operating the operation switch.

By using such hair iron 10, hair is held between first hair holding surface 560A and second hair holding surface 560B, and heat generated by heater 530A and heater 530B is applied to the hair through first hair holding surface 560A and second hair holding surface 560B so that the hair can be curled or straightened.

For example, curling of hair is performed as described below. First hair holder 40A and second hair holder 40B having been heated are disposed to face each other. Hair is held between first hair holding surface 560A and second hair holding surface 560B in a state in which the hair is disposed between first hair holder 40A and second hair holder 40B to extend in the width direction (Y-direction) of first hair holder 40A and second hair holder 40B.

Then, hair iron 10 is rotated while holding the hair such that the root side of the hair that is not held by first hair holding surface 560A and second hair holding surface 560B is put against exterior surface 420*a*A or exterior surface 420*a*B. In a state in which the hair is put against exterior surface 420*a*A or exterior surface 420*a*B, hair iron 10 is slidingly moved down along the hair toward the tip thereof, so that the hair is curled.

Straightening of hair is performed by sliding down hair iron 10 along the hair toward the tip thereof without rotating hair iron 10 while holding the hair between first hair holding surface 560A and second hair holding surface 560B.

In this manner, hair iron 10 of the first exemplary embodiment performs hair styling by applying heat on the hair.

First arm unit 20A described above includes first casing 210A that mainly forms an outer wall of first arm unit 20A, and a part of first casing 210A adjacent to pivotal connector 110 (the rear side in the X-direction of hair iron 10) forms first gripping unit casing 310A that forms an outer wall of first gripping unit 30A. A part of first casing 210A on a tip side thereof (a front side of hair iron 10 in the X-direction) forms first hair holder casing 410A that forms an outer wall of first hair holder 40A.

According to the first exemplary embodiment, an opening of upper housing 220A that opens downwardly is covered by lower housing 230A so that first casing 210A is formed in a hollow shape.

Specifically, an opening of upper housing 320A of the first gripping unit that opens downwardly is covered by cover 330A so that first gripping unit casing 310A is formed in a hollow shape. An opening of upper housing 420A of the first hair holder that opens downwardly is covered by first, hair holding member 50A to form first hair holder casing 410A.

According to the first exemplary embodiment, upper housing 220A is formed of upper housing 320A of the first gripping unit and upper housing 420A of the first hair holder, and lower housing 230A is formed of cover 330A and first hair holding member 50A, as described above.

According to the first exemplary embodiment, upper housing 320A of the first gripping unit and upper housing 420A of the first hair holder are integrated with each other. In other words, a part of upper housing 220A adjacent to pivotal connector 110 forms upper housing 320A of the first gripping unit, and a part of upper housing 220A on a tip side thereof forms upper housing 420A of the first hair holder.

Cover 330A and first hair holding member 50A are formed separately from each other, and form lower housing 230A when assembled to cover the opening of upper housing 220A.

According to the first exemplary embodiment, partition wall 240A is provided to divide hollow part S1 in first casing 210A into hollow part S2 in the first gripping unit and hollow part S3 in the first hair holder (see FIG. 4).

Partition wall 240A includes wall unit 221A protruding downwardly in the Z-direction from an inner side (lower surface side) of upper housing 220A at a center part in the X-direction (longitudinal direction, i.e., front-rear direction). Partition wall 240A also includes wall unit 333A protruding upwardly in the Z-direction from an inner side (upper surface side) of cover 330A at a front part in the X-direction. Partition wall 240A further includes packing 250A so that partition wall 240A is formed by holding packing 250A between wall unit 221A and wall unit 333A.

Hollow part S2 in the first gripping unit and hollow part S3 in the first hair holder accommodate various kinds of electrical components.

According to the first exemplary embodiment, electronic components (electrical components) such as high power circuit 340A are accommodated in hollow part S2 in the first gripping unit, and discharge device (electrical component) 600 is accommodated in hollow part S3 in the first hair holder. High power circuit 340A and discharge device (electrical component) 600 are electrically connected to each other through lead line 581A inserted into insertion hole 251A provided in packing 250A.

This configuration enhances water-tightness of the electronic components (electrical components) such as high power circuit 340A accommodated in hollow part S2 in the first gripping unit.

According to the first exemplary embodiment, tip end (a front end in the X-direction) 222A of upper housing 220A is curved downwardly (toward first hair holding surface 560A). Tip end 222A is curved in this manner so that a user can easily pick tip end 222A when using hair iron 10. In addition, tip end 222A includes protrusions 222*a*A serving as slip prevention when picking tip end 222A. Protrusions 222*a*A also have a function of dispersing heat transferred from heater 530A to tip end (a knob to be picked by a user) 222A.

Cover 330A includes above-described cylindrical unit 331A adjacent to pivotal connector 110 (a rear side in the X-direction), and includes downwardly-protruding stopper protrusion 332A (protruding toward second arm unit 20B) adjacent to wall unit 333A (a front side in the X-direction, i.e., adjacent to first hair holding member 50A).

First hair holding member 50A that forms a part of lower housing 230A includes plate member 510A, and plate member 510A is made of a material having high thermal conductivity, such as copper and aluminum. First hair holding member 50A includes holding member 520A that is supported by upper housing 420A of the first hair holder and holds plate member 510A, and heater 530A that is thermally connected to plate member 510A and transfers heat to plate member 510A.

Plate member 510A includes plate unit 540A having a plate shape (including a substantially plate shape), and first hair holding surface 560A having a flat shape (including a substantially flat shape) is provided on a surface (lower surface) of plate unit 540A. According to the first exemplary embodiment, first hair holding surface 560A has an elongated rectangular shape (including a substantially rectangular shape) in a longitudinal direction of first casing 210A in a plan view (as viewed from the bottom).

Both ends of plate unit 540A in the Y-direction (width direction, i.e., the same direction as the width direction of first hair holder 40A) are bent toward the inner side of first casing 210A. Both ends of first hair holding surface 560A in the Y-direction (width direction) respectively include curved surfaces 562A protruded diagonally outward in a cross-sectional view in the width direction (as viewed from a section cut by a surface along the width direction) as shown in FIG. 5.

In other words, first hair holding surface 560A includes flat surface (flat part) 561A at a center part in the width direction, and curved surfaces 562A respectively provided at both ends in the width direction of flat surface 561A.

Plate member 510A further includes a pair of leg parts 550A provided continuously from a back surface of (upper side) of plate unit 540A to face inward (upward), and the pair of leg parts 550A is held by holding member 520A so that plate member 510A is held by holding member 520A. Heater 530A is accommodated in housing unit 570A provided between leg parts 550A. Heater 530A accommodated in housing unit 570A is in contact with the inner surface of plate unit 540A.

In the first exemplary embodiment, a positive temperature coefficient heater (PTC heater) is used as heater 30A. A use of a PTC heater like this enables continuous temperature control. However, a use of a PTC heater is not necessarily required as a heater, and a nichrome wire heater or other heaters may be used.

Holding member 520A opens downwardly, and includes top wall 521A and side walls 522A, 522A that are provided continuously from both ends in the Y-direction of top wall 521A and extend downwardly.

Top wall 521A has a substantially mountain shape protruding upward in a cross-sectional view in the width direction, and a space part (hollow part S3) in which discharge device 600 is disposed is provided above top wall 521A (between top wall 521A and upper housing 420A of the first hair holder).

Top wall 521A includes upper flat part 521*a*A disposed at a center part in the Y-direction (width direction) and at an uppermost part of top wall 521A. Top wall 521A includes upper inclined parts 521*b*A, 521*b*A respectively provided continuously from both ends in the Y-direction (width direction) of upper flat part 521*a*A and extending downward and outward in the Y-direction. Top wall 521A also includes intermediate flat parts 521*c*A, 521*c*A respectively provided continuously from ends of upper inclined parts 521*b*A, 521*b*A and extending horizontally outward in the Y-direction. Top wall 521A also includes lower inclined parts 521*d*A, 521*d*A respectively provided continuously from ends of intermediate flat parts 521*c*A, 521*c*A and extending downward and outward in the Y-direction. Top wall 521A further includes lower flat parts 521*e*A, 521*e*A respectively provided continuously from ends of lower inclined parts 521*d*A, 521*d*A, and extending horizontally outward in the Y-direction. Side walls 522A described above are respectively provided continuously from ends in the Y-direction of lower flat parts 521*e*A, 521*e*A.

Second arm unit 20B includes second casing 210B that mainly forms an outer wall of second arm unit 20B, and a part of second casing 210B adjacent to pivotal connector 110 (the rear side in the X-direction of hair iron 10) forms second gripping unit side casing 310B that forms an outer wall of second gripping unit 30B. A part of second casing 210B on a tip side thereof (the front side in the X-direction of hair iron 10) forms second hair holder casing 410B forms an outer wall of second hair holder 40B.

According to the first exemplary embodiment, an opening of lower housing 220B that opens upwardly is covered by upper housing 230E so that second casing 210B is formed in a hollow shape.

Specifically, an opening of lower housing 320B of the second gripping unit that opens upwardly is covered by cover 330E so that second gripping unit casing 310B is formed in a hollow shape. An opening of lower housing 420B of the second hair holder that opens downwardly is covered by second hair holding member 50B to form second hair holder casing 410B.

According to the first exemplary embodiment, lower housing 220B is formed of lower housing 320E of the second gripping unit and lower housing 420B of the second hair holder, and upper housing 230B is formed of cover 3308 and second hair holding member 50B, as described above.

According to the first exemplary embodiment, lower housing 320B of the second gripping unit and lower housing 420E of the second hair holder are integrated with each other. In other words, a part of lower housing 220B adjacent to pivotal connector 110 forms lower housing 320B of the second gripping unit, and a part of lower housing 2208 on a tip side thereof forms lower housing 420B of the second hair holder.

Cover 330B and second hair holding member 50B are formed separately from each other, and form upper housing 230B when assembled to cover the opening of lower housing 220B.

According to the first exemplary embodiment, partition wall 240B is provided to divide hollow part S4 in second casing 210B into hollow part S5 in the second gripping unit and hollow part S6 in the second hair holder.

Partition wall 240B includes wall unit 221B protruding upwardly in the Z-direction from an inner side (upper surface side) of lower housing 220E at a center part in the X-direction (longitudinal direction, i.e., front-rear direction). Partition wall 240B also includes wall unit 333B protruding downwardly in the Z-direction from an inner side (lower surface side) of cover 330B at a front part in the X-direction. Partition wall 240B further includes packing 250B so that partition wall 240B is formed by holding packing 250B between wall unit 221B and wall unit 333B.

Hollow part S5 in the second gripping unit and hollow part S6 in the second hair holder accommodate various kinds of electrical components.

According to the first exemplary embodiment, hollow part S5 in the second gripping unit accommodates electronic components (electrical components) such as control device 340B configured to control heaters (heater 530A and heater 530B).

On the other hand, hollow part S6 in the second hair holder accommodates electrical components such as fuse 582B and thermistor 583B. Control device 340B is electrically connected to electrical components such as fuse 582B and thermistor 583B through lead line 581B inserted into insertion hole 251B provided in packing 250B.

This configuration enhances water-tightness of the electronic components (electrical components) such as control device 340B accommodated in hollow part S5 in the second gripping unit.

According to the first exemplary embodiment, tip end (a front end in the X-direction) 2228 of lower housing 220B is curved upwardly (toward second hair holding surface 560B). Tip end 222B is curved in this manner so that a user can easily pick tip end 222B when using hair iron 10. In addition, tip end 222B includes protrusions 222*a*B serving as slip prevention when picking tip end 222B. Protrusions 222*a*B also have a function of dispersing heat transferred from heater 530B to tip end (a knob to be picked by a user) 222B.

Cover 330B includes cylindrical unit 331B described above adjacent to pivotal connector 110 (the rear side in the X-direction), and includes stopper groove 332B depressed downwardly (toward second arm unit 20B) adjacent to wall unit 333B (a front side in the X-direction, i.e., adjacent to second hair holding member 50B). As previously mentioned, cylindrical unit 331B and cylindrical unit 331A form misalignment suppressing unit 150.

On the other hand, stopper groove 332B and stopper protrusion 332A form restriction unit 170 configured to restrict movements of first hair holder 40A relative to second hair holder 40B. Specifically, downwardly protruding stopper protrusion 332A is provided on a lower part of first casing 210A adjacent to first gripping unit 30A, and downwardly depressed stopper groove 332B is provided on an upper part of second, casing 210B adjacent to second gripping unit 30B. Rotational movements of first arm unit 20A and second arm unit 20B in a closing direction are restricted by abutting a tip of stopper protrusion 332A against a bottom surface of stopper groove 332B.

Second hair holding member 50B that forms a part of upper housing 230B includes plate member 510B, and plate member 510B is also made of a material having high thermal conductivity, such as copper and aluminum. Second hair holding member 50B includes holding member 520B that is supported by lower housing 420B of the second hair holder and holds plate member 510B, and heater 530B that is thermally connected to plate member 510E and transfers heat to plate member 510B.

Plate member 510B includes plate unit 540B having a plate shape (including a substantially plate shape), and second hair holding surface 560B having a flat shape (including a substantially flat shape) is provided on a surface (upper surface) of plate unit 540B. According to the first exemplary embodiment, second hair holding surface 560B has an elongated rectangular shape (including a substantially rectangular shape) in a longitudinal direction of second casing 210B in a plan view (as viewed from the bottom).

Both ends of plate unit 540B in the Y-direction (width direction, i.e., the same direction as the width direction of second hair holder 40B) are bent toward the inner side of second casing 210B. Both ends of second hair holding surface 560B in the Y-direction (width direction) respectively include curved surfaces 562B protruded diagonally outward in a cross-sectional view in the width direction as shown in FIG. 5.

In other words, second hair holding surface 560B includes flat surface (flat part) 561B at a center part in the width direction, and curved surfaces 562B respectively provided at both ends in the width direction of flat surface 561B.

Plate member 510B further includes a pair of leg parts 550B provided continuously from a back surface of (lower side) of plate unit 540B to face inward (downward), and the pair of leg parts 550B is held by holding member 520B so that plate member 510B is held by holding member 520B. Heater 530B is accommodated in housing unit 570B provided between leg parts 550B. Heater 530B accommodated in housing unit 570B is in contact with the inner surface of plate unit 540B.

Housing unit 570B accommodates electrical components such as fuse 582B and thermistor 583B on a back surface (lower side) of heater 530B. According to the first exemplary embodiment, housing unit 570B forms a part of hollow part S6 in the second hair holder. Accordingly, the electrical components such as fuse 582B and thermistor 583B are accommodated in housing unit 570B that forms a part of hollow part S6.

In the first exemplary embodiment, a positive temperature coefficient heater (PTC heater) is used as heater 530B. A use of a PTC heater like this enables continuous temperature control. However, a use of a PTC heater is not necessarily required as a heater, and a nichrome wire heater or other heaters may be used.

A heater (heating member) may be provided in either one of first hair holder 40A and second hair holder 40B.

According to the first exemplary embodiment, hollow part S5 in the second gripping unit accommodates control device 340B to control the heaters (heater 530A and heater 530B), as described above. Temperatures of first hair holding surface 560A and second hair holding surface 560B can be set stepwisely by control device 340B.

Specifically, thermistor 583B electrically connected to control device 340B is mounted on a back surface of plate unit 540B. Control device 340B controls the temperatures of the heaters (heater 530A and heater 530B) by utilizing a resistance value of thermistor 583B, specifically, a resistance value of thermistor 583B that changes according to changes in temperature of heater 530B.

According to the first exemplary embodiment, fuse 582B is provided on the back surface of plate unit 540B so that energization of the heaters (heater 530A and heater 530B) is turned off in the case where a temperature of first hair holding surface 560A and/or second hair holding surface 560B exceeds a predetermined temperature due to a breakage of control device 340B or the like. It is preferable that such a fuse is also provided on the back surface of plate unit 540A.

At least one of first hair holder 40A and second hair holder 40B is preferably supported in a relatively reciprocal manner in a vertical direction (in a direction normal to the hair holding surfaces) with respect to the housings of the hair holders (upper housing 420A of the first hair holder, lower housing 420B of the second hair holder).

According to the first exemplary embodiment, four corners of second hair holding member 50B are respectively supported by four float springs 5848 disposed in lower housing 420B of the second hair holder so that second hair holding member 50B can move vertically relative to lower housing 420B of the second hair holder.

This configuration suppresses excessive load to the hair held between first, hair holding surface 560A and second hair holding surface 560B, thereby suppressing damage to the hair.

According to the first exemplary embodiment, a predetermined gap d is provided between first hair holding surface 560A and second hair holding surface 560B in a state in which first arm unit 20A and second arm unit 20B are closed.

Specifically, a predetermined gap d is provided between first hair holding surface 560A and second hair holding surface 560B in a state in which the tip of stopper protrusion 332A is in contact with the bottom surface of stopper groove 332B. In addition, a predetermined gap d is provided between an entire surface of first hair holding surface 560A and an entire surface of second hair holding surface 560B.

Figure 7:
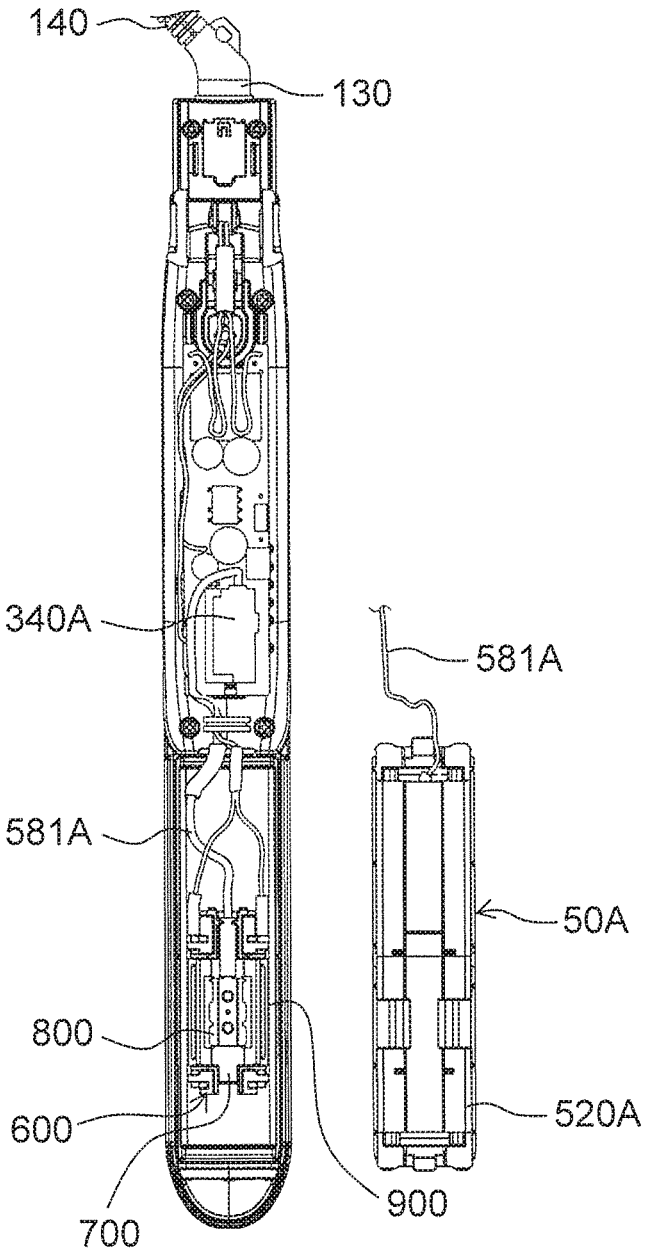
FIG. 7 is an exploded view showing an interior configuration of the first arm unit of the hair iron according to the first exemplary embodiment of the present disclosure.

As described above, discharge device 600 is provided in hollow part S3 in the first hair holder (see FIGS. 5 and 7).

According to the first exemplary embodiment, discharge device 600 includes first electrode 800 having discharge electrodes 830, and second electrodes 900 each having counter electrode (an electrode paired with discharge electrodes 830) 910 disposed separately from discharge electrodes 830, and an electrical discharge is generated between discharge electrodes 830 and counter electrode 910.

Discharge device 600 includes electrode holding member 700 holding first electrode 800. According to the first exemplary embodiment, electrode holding member 700 also holds second electrodes 900 in addition to first electrode 800. Electrode holding member 700 is placed on an upper part of first hair holding member 50A (see FIG. 8).

First electrode 800 may be made of metal or the like, for example, and has a shape obtained by bending both ends of a rectangular plate shaped member (including a substantially rectangular plate shape) in the same direction according to the first exemplary embodiment. The bent portions at both ends in the width direction of the first electrode 800 respectively form electrode bodies 810, 810 each having a rectangular plate shape (including a substantially rectangular plate shape), and a middle part having a rectangular plate shape (including a substantially rectangular plate shape) connecting two electrode bodies 810, 810 forms connecting unit 820.

Discharge electrodes 830 are provided at side portion 811 on one end (a side opposite to connecting unit 820) of electrode body 810 as electrode body 810 is viewed in a thickness direction of electrode body 810.

According to the first exemplary embodiment, a plurality of slits are provided on side portion 811 so that side portion 811 includes a plurality of discharge electrodes 830 projecting toward the one end of electrode body 810.

Figure 11:
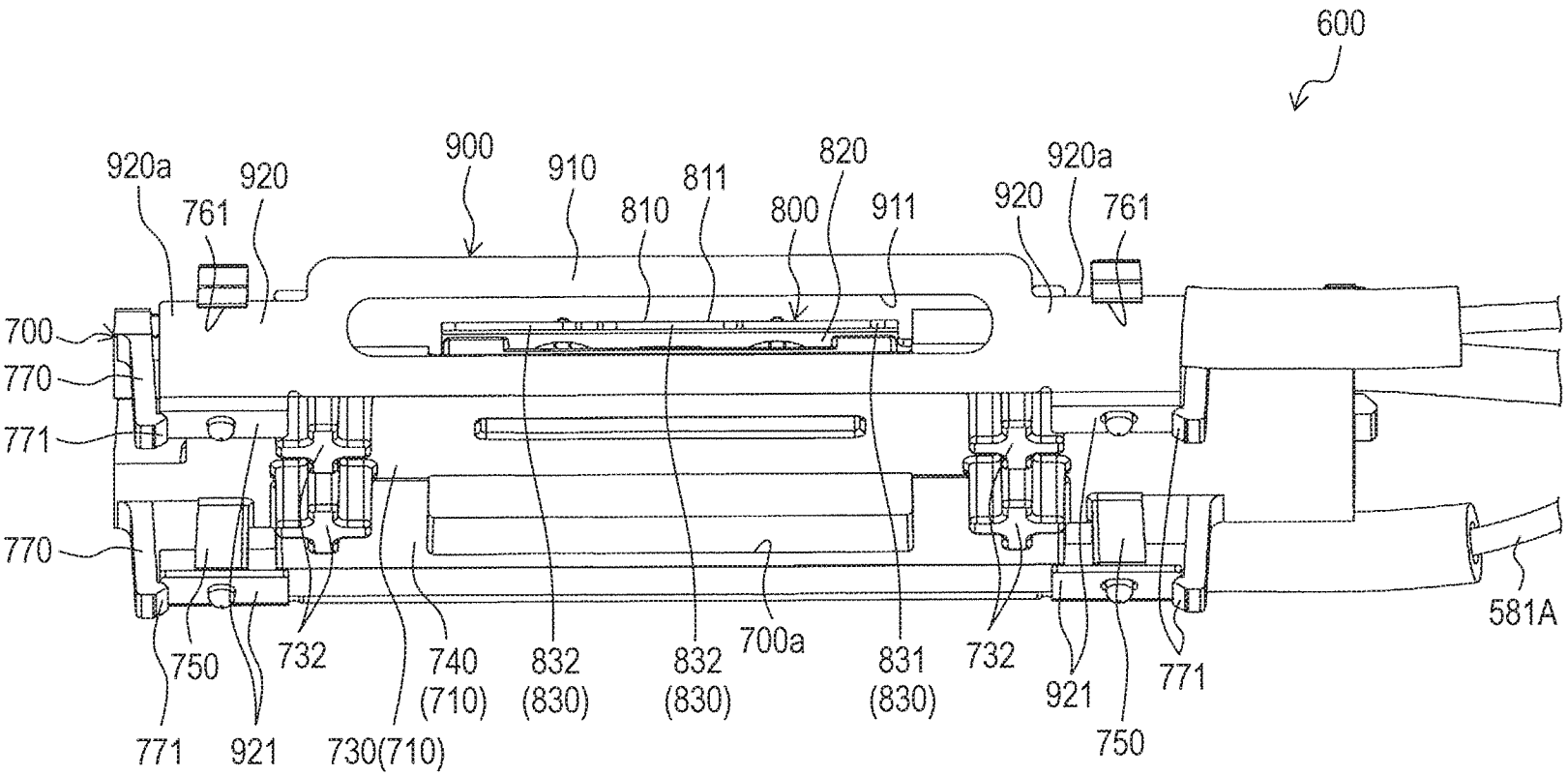
FIG. 11 is a perspective view of the discharge device of the hair iron according to the first exemplary embodiment of the present disclosure as viewed from a protruding direction of discharge electrodes.

As viewed from the one end (in a projecting direction of discharge electrodes 830), side portion 811 has a long narrow rectangular shape in one direction (the thickness direction becomes a lateral direction) (see FIG. 11).

According to the first exemplary embodiment, discharge electrodes 830 include two types of discharge electrodes 831, 832 of which shapes are different from each other.

Specifically, at least one discharge electrode 830 among discharge electrodes 830 is needle-shaped discharge electrode 831 that has a narrow shape and projects toward the one end in a pointed state (tip thereof has a substantially needle shape) as electrode body 810 is viewed from the thickness direction thereof.

At least one discharge electrode 830 among discharge electrodes 830 is plate-shaped discharge electrode 832 which has a wide shape and has a flat tip as electrode body 810 is viewed from the thickness direction thereof.

According to the first exemplary embodiment, each of electrode bodies 810, 810 on both sides of connecting unit 820 includes one needle-shaped discharge electrode 831 and two plate-shaped discharge electrodes 832, 832.

On the other hand, each of second electrodes 900 includes counter electrode 910, and can be formed by pressing a substantially plate-shaped member such as metal, for example. According to the first exemplary embodiment, each of second electrodes 900 includes counter electrode 910 provided at a middle part in a longitudinal direction (in the X-direction in a state where hair iron 10 is assembled), and a pair of mounting portions 920, 920 continuously provided from both ends of counter electrode 910 in the longitudinal direction (in the X-direction in a state where hair iron 10 is assembled).

According to the first exemplary embodiment, through hole 911 having a long narrow shape in the X-direction is provided at a center part of counter electrode 910, and counter electrode 910 is formed in a frame shape (including substantially frame shape).

Figure 10:
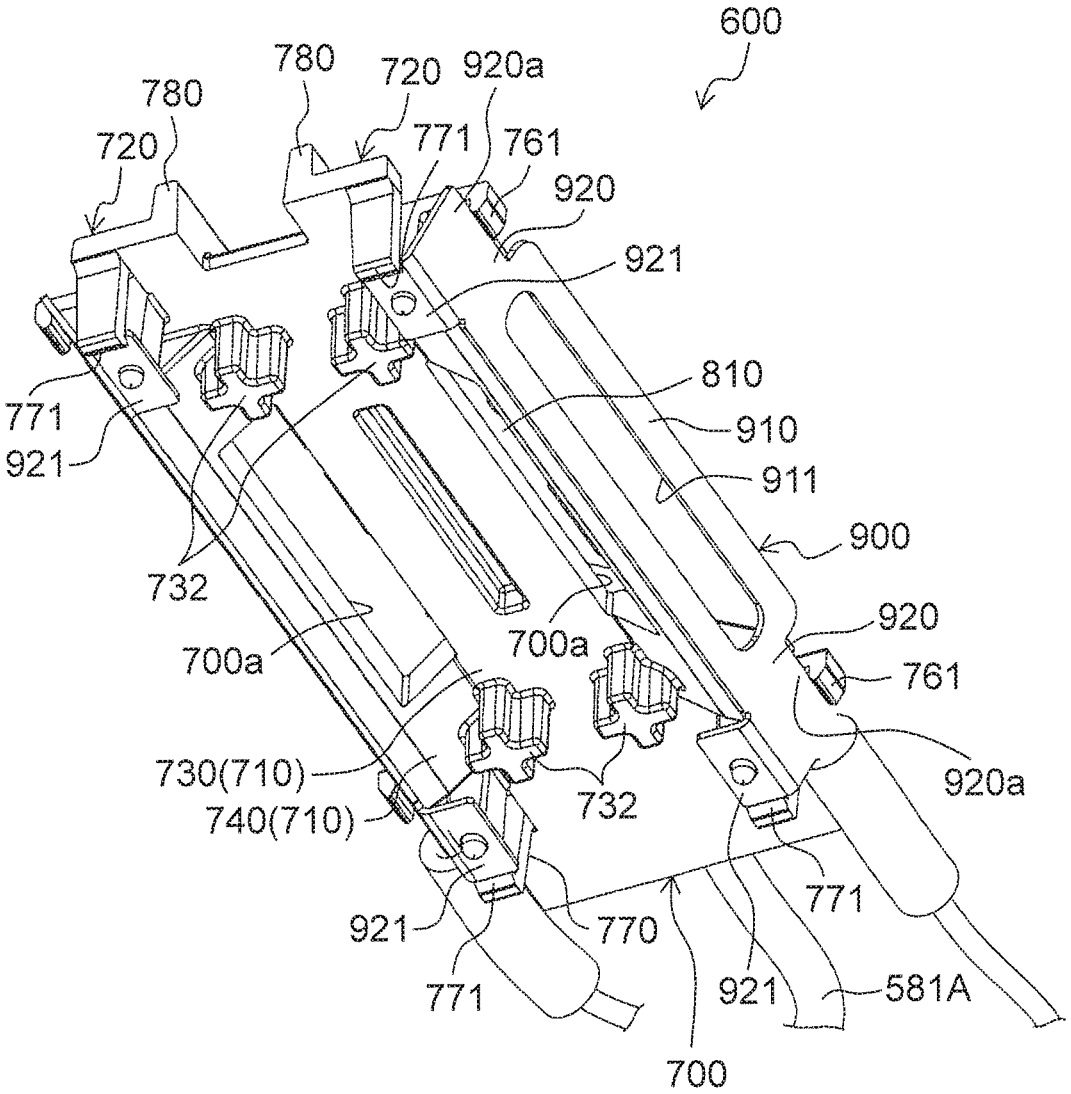
FIG. 10 is a bottom perspective view of the discharge device of the hair iron according to the first exemplary embodiment of the present disclosure.

Mounting portions 920, 920 respectively have bent pieces 921, 921 bending in the same direction at one end in the lateral direction of each of mounting portions 920, 920 (see FIG. 10).

According to the first exemplary embodiment, two second electrodes 900 having the same shape (including substantially same shape) are provided, an electrical discharge is generated between counter electrode 910 of one of second electrodes 900 and discharge electrodes 830 provided on one of electrode bodies 810, and an electrical discharge is also generated between counter electrode 910 of the other one of second electrodes 900 and discharge electrodes 830 provided on the other one of electrode bodies 810.

Discharge electrodes 830 and counter electrodes 910 are electrically connected to high power circuit 340A through lead line 581A so that electrical discharges (corona discharge or the like) can be generated by applying high voltages between needle-shaped discharge electrode 831 among discharge electrodes 830 and counter electrode 910 and between plate-shaped discharge electrodes 832 among discharge electrodes 830 and counter electrode 910.

First electrode 800 and two second electrodes 900 are disposed in hollow part S3 in the first hair holder while being held by electrode holding member 700.

Electrode holding member 700 includes base unit 710 supporting first electrode 800. Base unit 710 includes flat part 730 extending horizontally (including almost horizontally) at a middle part in the Y-direction (width direction), and inclination units 740, 740 provided on both sides in the Y-direction (width direction) of flat part 730 and extending downwardly and outwardly in the Y-direction (width direction). Inclination units 740, 740 are provided in such a manner that electrode bodies 810, 810 face each other in parallel (including substantially in parallel) when first electrode 800 is installed.

According to the first exemplary embodiment, upwardly protruding holding stand 731 is provided at a center upper portion of flat part 730, and connecting unit 820 of first electrode 800 is mounted on an upper part of holding stand 731 so that first electrode 800 is held by electrode holding member 700.

Figure 9:
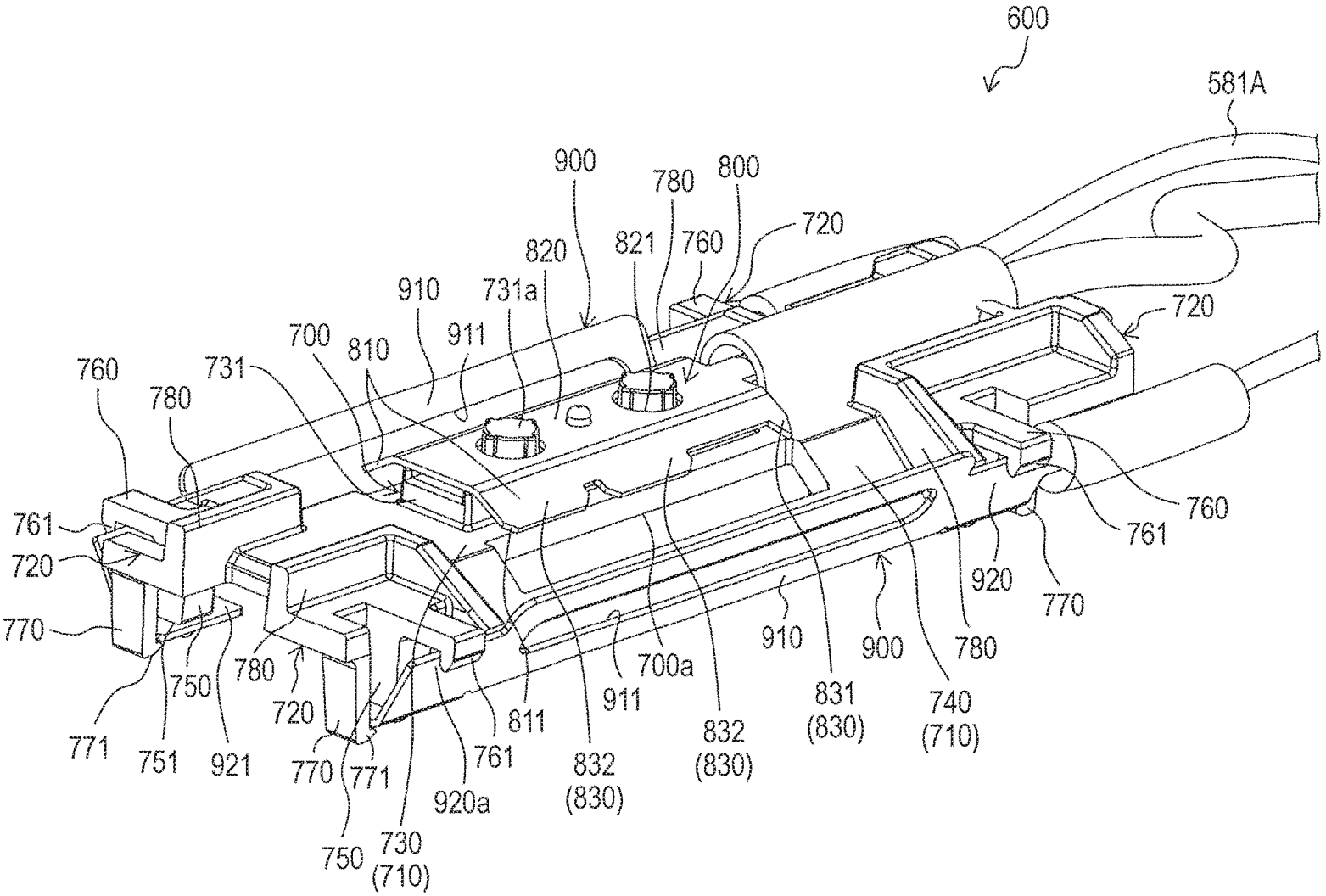
FIG. 9 is a top perspective view of the discharge device of the hair iron according to the first exemplary embodiment of the present disclosure.

Specifically, the upper part of holding stand 731 includes two positioning protrusions 731*a*, 731*a* protruding upwardly (see FIG. 9). While positioning protrusions 731*a*, 731*a* are respectively inserted in insertion holes 821, 821 formed on connecting unit 820, connecting unit 820 is fixed on holding stand 731 so that first electrode 800 is held by electrode holding member 700. Each of discharge electrodes 830, 830 provided on both sides in the Y-direction of connecting unit 820 projects downwardly and outwardly in the Y-direction.

Positioning protrusions 731*a*, 731*a* are provided with tip ends thereof being positioned above connecting unit 820 so that first electrode 800 is separated from upper housing 420A of the first hair holder.

Referring to FIG. 9, a lower part of holding stand 731 has four leg parts 732 protruding downwardly. Four leg parts 732 are placed on upper flat part 521*a*A (see FIGS. 5 and 8).

Electrode holding member 700 includes second electrode holders 720 holding second electrodes 900. According to the first exemplary embodiment, second electrode holders 720 are provided at four corners of flat part 730, and each of second electrode holders 720 is integrated with flat part 730.

According to the first exemplary embodiment, each of second electrode holders 720 includes leg part 750 that protrudes downwardly, extension unit 760 that extends horizontally (including substantially horizontally) and outwardly in the Y-direction, and extension unit 770 that extends downwardly and vertically (including substantially vertically).

Lower surfaces 751, 751 of two leg parts 750, 750 aligned in the X-direction on one side in the Y-direction are respectively attached with bent pieces 921, 921 of one of second electrodes 900.

Tips of extension units 760 respectively include engaging catches 761, and two engaging catches 761, 761 aligned in the X-direction on one side in the Y-direction are respectively engaged with edges 920*a*, 920*a* of mounting portions 920, 920 provided on one of second electrodes 900.

Tips of extension units 770 respectively include engaging catches 771, and two engaging catches 771, 771 aligned in the X-direction on one side in the Y-direction are respectively engaged with bent pieces 921, 921 of mounting portions 920, 920 provided on one of second electrodes 900.

With this configuration, second electrode 900 is held by second electrode holder 720.

Figure 8:
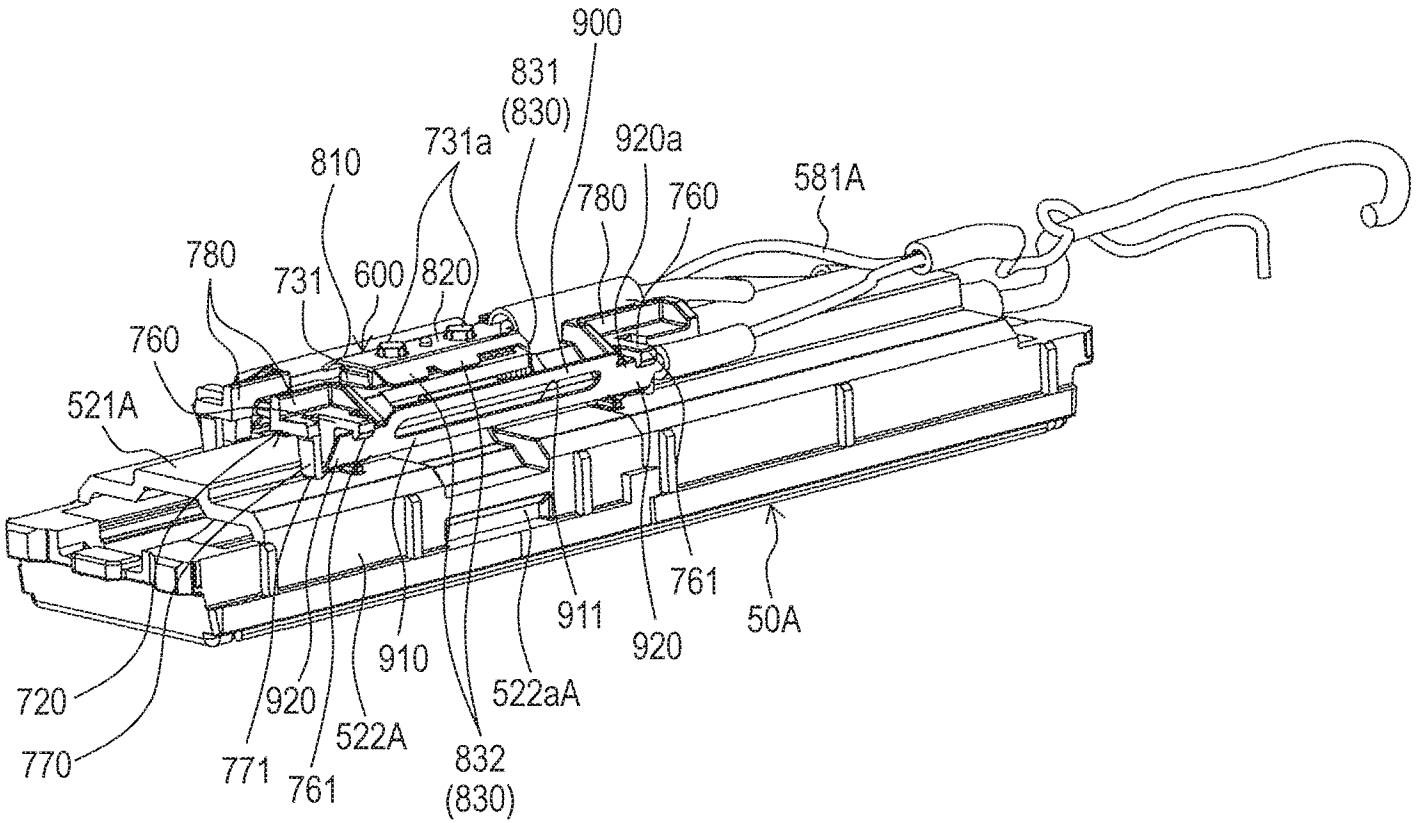
FIG. 8 is a perspective view showing a state in which a discharge device is placed on a first hair holding member of the hair iron according to the first exemplary embodiment of the present disclosure.

Extension units 770 protrude below lower surfaces 751 of leg parts 750, and lower ends of four extension units 770 are placed on intermediate flat parts 521*c*A, 521*c*A (see FIGS. 5 and 8).

Since the lower ends of extension units 770 protruding below lower surfaces 751 are placed on intermediate flat parts 521*c*A, 521*c*A as described above, second electrodes 900 are disposed separately from holding member 520A.

The other one of second electrodes 900 is held by second electrode holders 720, 720 on the other side in the Y-direction in the same manner.

According to the first exemplary embodiment, each of counter electrodes 910 extends in a direction orthogonal (including substantially orthogonal) to a protruding direction of discharge electrodes 830 in a state in which first electrode 800 and second electrodes 900 are held by electrode holding member 700.

As viewed from the protruding direction of discharge electrodes 830, side portion 811 having discharge electrodes 830 is positioned at a center (including substantially center) of through hole 911 provided in each of counter electrodes 910 (see FIG. 11). In other words, as side portion 811 is viewed from one end, frame-shaped counter electrode 910 is disposed to surround the four sides of side portion 811 (along all of the four sides of rectangular shape elongated in the X-direction).

Counter electrode 910 does not necessarily have a frame-shape. It is only required that counter electrode 910 is disposed to surround at least two sides of side portion 811. For example, two linear counter electrodes may be disposed along two long sides of side portion 811, or a substantially L-shaped counter electrode may be disposed along a long side and a short side of side portion 811.

According to the first exemplary embodiment, second electrode holder 720 further includes insulation wall 780 so that insulation wall 780 suppresses generation of an electrical discharge between discharge electrodes 830 and mounting portions 920, 920.

Discharge device 600 may be a charged fine particle generation device configured to generate a charged fine particulate liquid (such as mist, for example), or a metal fine particle generation device configured to generate metal fine particles, for example.

Ions (a charged fine particulate liquid such as mist or metal fine particles) generated by the discharge device (a charged fine particle generation device or a metal fine particle generation device) 600 are released outside from ion outlet 421A. With this configuration, ions generated by discharge device 600 are supplied to hair through ion outlet 421A, thereby further enhancing hair care effects.

According to the first exemplary embodiment, ion outlets 421A, 421A are respectively provided on both sides in the Y-direction of upper housing 420A of the first hair holder so as to communicate with hollow part S3 in the first hair holder.

Side portions 811 including discharge electrodes 830 are disposed to face ion outlets 421A, 421A, respectively (see FIG. 5). In other words, ion outlets 421A, 421A are provided on upper housing 420A of the first hair holder so as to position in the protruding direction of discharge electrodes 830.

Figure 6:
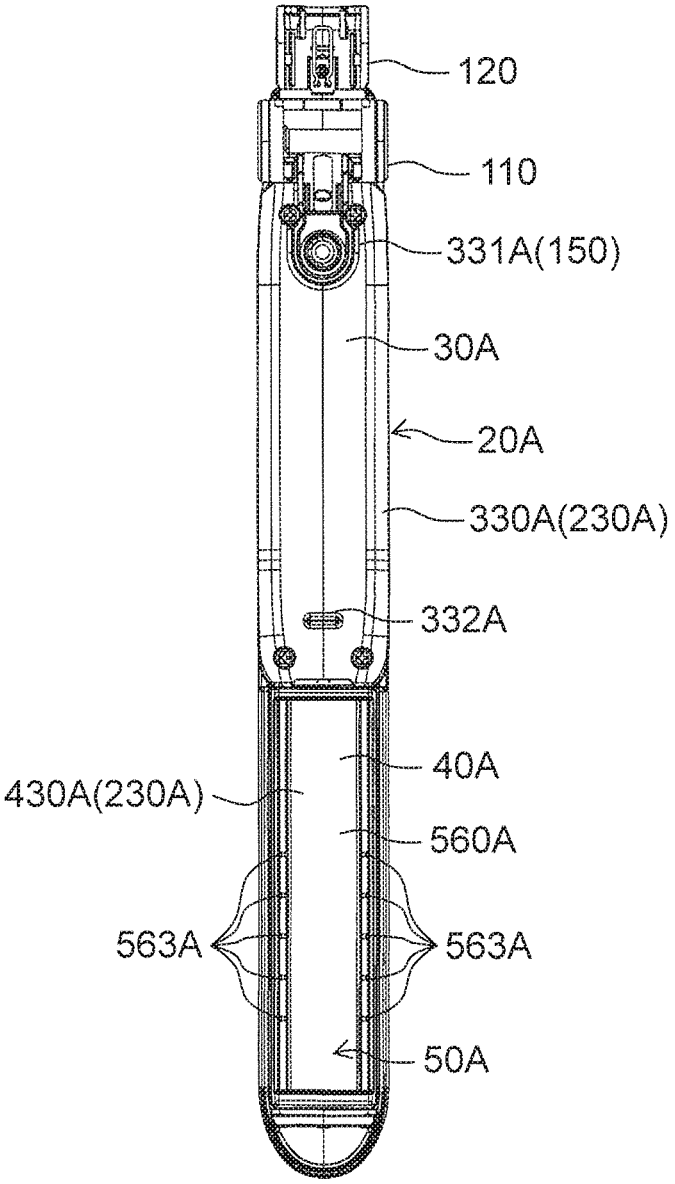
FIG. 6 shows a first arm unit of the hair iron according to the first exemplary embodiment of the present disclosure as viewed from the first hair holding surface.

According to the first exemplary embodiment, liquid passage 440A to supply liquid such as water to discharge electrodes 830 is provided in first hair holder 40A. An upstream end of liquid passage 440A includes liquid inlets 563A to introduce liquid into liquid passage 440A (see FIG. 6).

According to the first exemplary embodiment, liquid inlets 563A are provided on both sides in the Y-direction of first hair holding surface 560A. Specifically, a plurality of liquid inlets 563A are aligned in the X-direction on one side in the Y-direction of first hair holding surface 560A, and a plurality of liquid inlets 563A are aligned in the X-direction on the other side in the Y-direction of first hair holding surface 560A (see FIG. 6).

According to the first exemplary embodiment, liquid inlets 563A are provided on a lower end of through hole 541A provided on plate unit 540A (see FIG. 5).

According to the first exemplary embodiment, through hole 541A provided on plate unit 540A forms a part of liquid passage 440A.

Referring to FIG. 5, each of side walls 522A includes window part 522*a*A, and window part 522*a*A also forms a part of liquid passage 440A.

Through hole 700*a* is also provided on electrode holding member (electrode holder) 700 holding first electrode 800 (electrode body 810) below (near) discharge electrodes 830, and through hole 700*a* also forms a part of liquid passage 440A.

In this manner, according to the first exemplary embodiment, liquid passage 440A includes through hole 541A having liquid inlets 563A, a space between leg parts 550A and side walls 522A, and window part 522*a*A. Liquid passage 440A includes a space between side walls 522A and upper housing 420A of the first hair holder, a space between top wall 521A of holding member 520A and base unit 710 of electrode holding member 700, and through hole 700*a*.

As described above, liquid inlets 563A are provided to introduce liquid such as moisture retained by the hair held between first hair holding surface 560A and second hair holding surface 560B (or introduce a hair treatment agent or the like, as another example) into liquid passage 440A.

On the other hand, ion outlets 421A are provided to supply ions (negative ions or positive ions) or charged fine particulate liquid generated by an electrical discharge generated between needle-shaped discharge electrode 831 (discharge electrode 830) and counter electrode 910 and between plate-shaped discharge electrodes 832 (discharge electrodes 830) and counter electrode 910 to the outside of hollow part S3 in the first hair holder.

Accordingly, during the usage of hair iron 10, liquid such as moisture retained by the hair held between first hair holding surface 560A and second hair holding surface 560B is introduced into liquid passage 440A through liquid inlets 563A.

Liquid such as moisture introduced into liquid passage 440A comes in contact with needle-shaped discharge electrode 831 (discharge electrode 830) or plate-shaped discharge electrodes 832 (discharge electrodes 830) to cause condensation. At this time, using plate-shaped discharge electrodes 832 as discharge electrodes 830 results in an increase in exposure area of electrodes, thereby efficiently causing the condensation of the liquid such as moisture.

In addition, discharge electrodes 830 are provided adjacent to counter electrode 910 so as to face counter electrode 910 and are separated in the X-direction from each other by the plurality of slits. Accordingly, virtual needles are provided on side portion 811 on one side of electrode body 810 at a position opposing to counter electrode 910, thereby causing electric field concentration at the virtual needles when applying a high voltage. As a result, an electrical discharge can be generated more efficiently.

An electrical discharge may be generated without causing condensation of liquid such as moisture to generate only ions.

When generating an electrical discharge, a negative voltage may be applied to the electrodes to generate negative ions, or a positive voltage may be applied to the electrodes to generate positive ions.

Alternatively, a negative voltage and a positive voltage may be applied alternately to the electrodes to generate negative ions and positive ions alternately, or a negative voltage may be applied to any of the electrodes and a positive voltage may be applied to the remainder of the electrodes to generate negative ions and positive ions simultaneously.

Here, an example of effects in the case where hair iron 10 with the above-described configuration is used will be described.

First, the heaters (heater 530A and heater 530B) are energized by operating the operation switch (not shown) provided on hair iron 10. This allows the heaters (heater 530A and heater 530B) to generate heat, so that heat is transferred from the heaters (heater 530A and heater 530B) to plate unit 540A and plate unit 540B. With this configuration, plate unit 540A and plate unit 540B are heated.

First hair holding surface 560A arc second hair holding surface 560B are then heated to keep a predetermined temperature (for example, 170° C.).

At this time, a high voltage is applied between needle-shaped discharge electrode 831 and counter electrode 910 to generate an electrical discharge (corona discharge or the like), whereby mainly ions (negative ions and/or positive ions) are generated. Meanwhile, a high voltage is applied between plate-shaped discharge electrodes 832 and counter electrode 910 to generate an electrical discharge (corona discharge or the like), whereby mainly charged fine particulate liquid is generated. The ions (negative ions and/or positive ions) and charged fine particulate liquid thus generated are released from ion outlets 421A.

In a state in which ions (negative ions and/or positive ions) and charged fine particulate liquid are released from ion outlets 421A while heating first hair holding surface 560A and second hair holding surface 560B, a part of hair is held between first hair holding surface 560A and second hair holding surface 560B.

In the case where hair is to be curled, hair iron 10 is then rotated by more than one half rotation while holding the part of hair such that the other part of hair which is not held between first hair holding surface 560A and second hair holding surface 560B is wound around the exterior surfaces (exterior surface 420*a*A and exterior surface 420*a*B) in a spiral manner.

Hair iron 10 is moved slidingly down along the hair toward the tip end thereof while the hair is pressed against the exterior surfaces (exterior surface 420*a*A and exterior surface 420*a*B), whereby the hair is curled.

In the case where hair is to be straightened, hair iron 10 is moved slidingly down along the hair toward the tip end thereof without rotating hair iron 10 while holding the hair between first hair holding surface 560A and second hair holding surface 560B. The hair is then straightened.

At this moment, the hair is to be curled or straightened while being supplied with the ions (negative ions and/or positive ions) and/or the charged fine particulate liquid. For example, in the case where a charged fine particle generation device configured to generate mist is provided, condensation water is atomized due to a discharge action such as a corona discharge, and nano-meter sized extremely fine mist (negatively charged mist including negative ions) are generated and supplied to the hair.

In the case where a metal fine particle generation device is provided, metal fine particles (metal molecules, ions, or the like) are released from discharge electrodes 830, counter electrode 910, and the like due to a discharge action such as a corona discharge, and the metal fine particles are then supplied to the hair.

The discharge electrodes and the counter electrode of the metal fine particle generation device may be made of a simple substance or an alloy of a transition metal (for example, gold, silver, copper, platinum, zinc, titanium, rhodium, palladium, iridium, ruthenium, osmium, or the like) or a plated transition metal.

In the case where metal fine particles generated by and released from a discharge unit include gold, silver, copper, zinc, or the like, the metal fine particles can bring about antimicrobial effects. In the case where metal fine particles include platinum, zinc, titanium, or the like, the metal fine particles can bring about antioxidant effects.

Platinum fine particles are known to possess potent antioxidant properties. A portion which does not release metal fine particles (for example, an electrode serving as a ground electrode, or the like) may be made of stainless steel, tungsten, or the like.

Metal fine particles may be venerated by allowing ions (for example, negative ions such as $NO_2$, $NO_3$, or the like) generated by a discharge action caused by the discharge unit to collide against the discharge electrodes, the counter electrodes, or other members including metal materials or a metal component. In other words, the counter electrodes or the other members may be made of a material including the transition metal so that metal fine particles are released from such members.

With this configuration, damages to the hair can be suppressed when the hair is set by using hair iron 10.

As described above, hair iron 10 according to the first exemplary embodiment includes: first hair holder 40A with first hair holding surface 560A; and second hair holder 40B with second hair holding surface 560B configured to face the first hair holding surface 560A. Hair iron 10 is configured to hold hair in a state in which first hair holding surface 560A and second hair holding surface 560B face each other.

First hair holder 40A includes discharge device 600 configured to generate ions, and first hair holder 40A also includes ion outlets 421A configured to release ions generated by discharge device 600.

Discharge device 600 includes first electrode 800 having discharge electrodes 830, and first electrode 800 includes electrode body 810 having a plate shape (including a substantially plate shape).

Discharge electrodes 830 are disposed on side portion 811 on one end of electrode body 810 as electrode body 810 is viewed in a thickness direction of electrode body 810, and discharge electrodes 830 include two types of discharge electrodes 831, 832 of which shapes are different from each other.

Since discharge electrodes 830 are disposed on side portion 811 on one end of electrode body 810 as described above, an installation space of discharge device 600 can be minimized in first hair holder 40A, thus being capable of attaining a slimmed body of hair iron 10. In addition, since discharge electrodes 830 include two types of discharge electrodes 831, 832 of which shapes are different from each other, the two types of discharge electrodes 831, 832 can have different primary functions, thereby enhancing hair care effects.

In this manner, hair iron 10 according to first exemplary embodiment is capable of attaining a slimmed, body while enhancing hair care effects.

According to the first exemplary embodiment, discharge device 600 includes second electrode 900 having counter electrode 910 that is separated from discharge electrodes 830 to generate an electrical discharge between counter electrode 910 and each of discharge electrodes 830.

Counter electrode 910 is disposed to surround at least two sides of side portion 811 as side portion 811 is viewed from the one end of electrode body 810.

Since discharge electrodes 830 are disposed on side portion 811 on one end of electrode body 810 and counter electrode 910 configured to generate an electrical discharge between counter electrode 910 and, each of discharge electrodes 830 is disposed to surround at least two sides of side portion 811 on which discharge electrodes 830 are provided, electric field concentration can be reduced on the side of the counter electrode 910. As a result, occurrence of arcing is suppressed between discharge electrodes 830 and counter electrode 910, so that counter electrode 910 can be disposed closer to discharge electrodes 830, thereby minimizing an installation space of the discharge device 600 in first hair holder 40A.

According to the first exemplary embodiment, counter electrode 910 may have a frame shape and may be disposed to surround four sides of the side portion 811 as the side portion 811 is viewed from the one end of the electrode body 810.

With this configuration, since electric field concentration can be further reduced on the side of counter electrode 910, counter electrode 910 can be disposed closer to discharge electrode 830. This results in a further reduction of an installation space of the discharge device 600 in first hair holder 40A.

According to the first exemplary embodiment, first hair holder 40A may include liquid passage 440A having liquid inlets 563A and configured to supply liquid to the discharge electrode 830.

This configuration enables liquid to be pulverized into charged fine particles in the discharge device 600 without providing a liquid supply mechanism in the discharge device 600.

According to the first exemplary embodiment, electrode holding member (electrode holder) 700 holding electrode body 810 is provided in first hair holder 40A, and through hole 700*a* that forms a part of liquid passage 440A is provided in electrode holding member (electrode holder) 700 below (near) discharge electrode 830.

This configuration enables saving in space for liquid passage 440A and also enables the liquid introduced from liquid inlets 563A to be more efficiently supplied to discharge electrode 830.

Through hole 700*a* that forms a part of liquid passage 440A is provided below discharge electrode 830 in electrode holding member (electrode holder) 700, thus preventing liquid passage 440A from interfering with an ion outlet path extending in the Y-direction. In addition, providing through hole 700*a* below discharge electrode 830 improves a balance of electric field concentration between discharge electrode 830 and counter electrode 910, so that an electrical discharge can be generated more stably.

According to the first exemplary embodiment, liquid inlets 563A are provided on first hair holding surface 560A.

Disposing liquid inlets 563A on first hair holding surface 560A eliminates the need of securing a place for liquid inlets 563A on the outside of first hair holding surface 560A, thereby enabling hair iron 10 to have a further slimmed body.

According to the first exemplary embodiment, liquid inlets 563A are provided on an end of first hair holding surface 560A.

This configuration can suppress a situation where a hair holding part in first hair holding surface 560A is divided by liquid inlets 563A. As a result, hair iron 10 can attain a further slimmed body while suppressing impairment of a treatment effect.

As described above, although the preferred embodiments of the disclosure are described above, the disclosure is not limited to the embodiments, and various modifications are possible.

For example, discharge device 600 can be applied to a hair iron in which the first hair holding surface and the second hair holding surface are configured to come in contact with each other.

The discharge electrodes provided on the side portion may have the same shape, or a single discharge electrode may be provided on the side portion.

The counter electrode can be disposed not to face the plate-shaped discharge electrode and the needle-shaped discharge electrodes.

An electrical discharge may be generated between the discharge electrode and a component near the discharge electrode without providing a counter electrode.

The discharge device may be provided not only in the upper hair holder but also in the lower hair holder, or may be disposed only in the lower hair holder. In the case where the discharge electrode is provided only in the lower hair holder, the lower hair holder is a first hair holder and the upper hair holder is a second hair holder.

In addition, the specifications (shape, size, layout, or the like) of the grips, the hair holders, and the other details can be changed as appropriate.

As described above, the hair iron according to the present disclosure is capable of attaining a slimmed body while enhancing hair care effects, and thus can be applied to, for example, a pet hair iron, or an iron in a processing device of chemical fibers used in clothes or the like.

What is claimed is:

1. A hair iron comprising:

a first hair holder with a first hair holding surface; and a second hair holder with a second hair holding surface configured to face the first hair holding surface, the hair iron being configured to hold hair in a state in which the first hair holding surface and the second hair holding surface face each other, wherein the first hair holder includes a discharge device configured to generate ions, the first hair holder includes ion outlets configured to release ions generated by the discharge device, the discharge device includes a first electrode having a plurality of discharge electrodes, the first electrode includes an electrode body having a plate shape, the discharge electrodes are disposed on a side portion on one end of the electrode body as the electrode body is viewed in a thickness direction of the electrode body, the discharge electrodes include two types of discharge electrodes of which shapes are different from each other, the discharge device includes a second electrode having a counter electrode that is separated from the discharge electrodes to generate an electrical discharge between the counter electrode and each of the discharge electrodes, and the counter electrode is disposed to surround at least two sides of the side portion as the side portion is viewed from the one end of the electrode body.

2. The hair iron according to claim 1, wherein the counter electrode has a frame shape and is disposed to surround four sides of the side portion as the side portion is viewed from the one end of the electrode body.

3. The hair iron according to claim 1, wherein the first hair holder includes a liquid passage having a liquid inlet and configured to supply liquid to the discharge electrode.

4. The hair iron according to claim 3, wherein the first hair holder includes an electrode holder holding the electrode body, and a through hole that forms a part of the liquid passage is provided in the electrode holder near the discharge electrode.

5. The hair iron according to claim 3, wherein the liquid inlet is disposed on the first hair holding surface.

6. The hair iron according to claim 5, wherein the liquid inlet is disposed on an end of the first hair holding surface.

7. A hair iron comprising:

a first hair holder with a first hair holding surface; and a second hair holder with a second hair holding surface configured to face the first hair holding surface, the hair iron being configured to hold hair in a state in which the first hair holding surface and the second hair holding surface face each other, wherein the first hair holder includes a discharge device configured to generate ions, the first hair holder includes ion outlets configured to release ions generated by the discharge device, the discharge device includes a first electrode having a discharge electrode, and a second electrode having a counter electrode that is separated from the discharge electrode to generate an electrical discharge between the counter electrode and the discharge electrode, the first electrode includes an electrode body having a plate shape, the discharge electrode is disposed on a side portion on one end of the electrode body as the electrode body is viewed in a thickness direction of the electrode body, the counter electrode is disposed to surround at least two sides of the side portion as the side portion is viewed from the one end of the electrode body, and the counter electrode has a frame shape and is disposed to surround four sides of the side portion as the side portion is viewed from the one end of the electrode body.

8. The hair iron according to claim 7, wherein the first hair holder includes a liquid passage having a liquid inlet and configured to supply liquid to the discharge electrode.

9. The hair iron according to claim 8, wherein the first hair holder includes an electrode holder holding the electrode body, and a through hole that forms a part of the liquid passage is provided in the electrode holder near the discharge electrode.

10. The hair iron according to claim 8, wherein the liquid inlet is disposed on the first hair holding surface.

11. The hair iron according to claim 10, wherein the liquid inlet is disposed on an end of the first hair holding surface.

* * * * *